United States Patent [19]

Barton

[11] Patent Number: 4,483,085

[45] Date of Patent: Nov. 20, 1984

[54] PHOTOGRAPH DISPLAY AND STORAGE DEVICE

[76] Inventor: Robert J. Barton, 11845 West Ave., Apt. 203, San Antonio, Tex. 78216

[21] Appl. No.: 559,103

[22] Filed: Dec. 7, 1983

[51] Int. Cl.[3] ..... A47G 1/06

[52] U.S. Cl. ..... 40/156; 40/152; 40/152.1

[58] Field of Search ..... 40/152.1, 152, 156

[56] References Cited

U.S. PATENT DOCUMENTS 2,614,353 10/1952 Goldman ..... 40/152.1
2,815,599 12/1957 Jablon ..... 40/152
3,240,142 3/1966 O'Brien, Jr. ..... 40/152
3,782,015 1/1974 Esry ..... 40/154

*Primary Examiner*—Gene Mancene
*Assistant Examiner*—Cary E. Stone
*Attorney, Agent, or Firm*—John C. Stahl

[57] ABSTRACT

A photograph display and storage device for displaying a mounted photograph or the like and additionally storing a plurality of other mounted photographs, the device permitting rapid change of the photograph being displayed. The device may lie flat upon any supporting surface or detachably secured to a stand in a rearwardly tilted direction to provide an eye-pleasing effect for the displayed photograph.

3 Claims, 11 Drawing Figures

PHOTOGRAPH DISPLAY AND STORAGE DEVICE

BACKGROUND OF THE INVENTION

The prior art is replete with picture display and storage devices. Typical prior art teachings include U.S. Pat. Nos. 699,595, 1,940,328, 2,072,167, 3,771,244 and 3,782,015.

None of these teachings feature means whereby any desired number of mounted photographs or the like are positively secured in said device.

SUMMARY OF THE INVENTION

The primary object of the invention is to provide a photograph display and storage device whereby one of a plurality of mounted photographs or the like may be displayed and the remainder stored, in flat and protected condition.

Another object is to provide such a device wherein the photograph or the like being displayed may quickly and easily be changed.

Still another object is to provide such a device adapted to be detachably secured in a rearwardly inclined direction to provide an eye-pleasing effect for the displayed photograph or the like, regardless of the number of photographs or the like carried in said device.

A further object is to provide such a device which is relatively inexpensive to manufacture, easy to use, and universal in its adaptability.

Other objects and features of the invention will become apparent to those skilled in the art from the following specification when read in the light of the annexed drawings.

DESCRIPTION OF PREFERRED EMBODIMENTS

Figure 1:
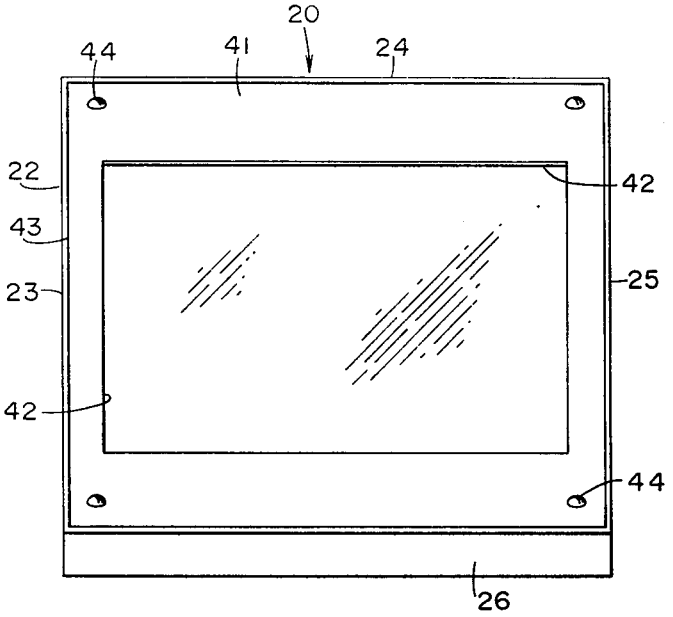
FIG. 1 is a perspective view of the photograph display and storage device of the subject invention.
Figure 8:
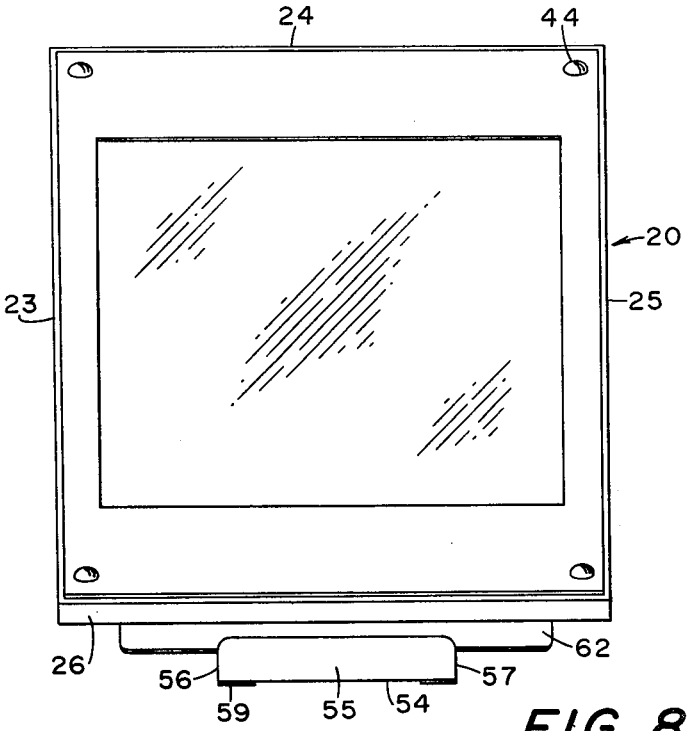
FIG. 8 is a front elevational view showing the embodiment of FIG. 1 mounted on a stand.
Figure 9:
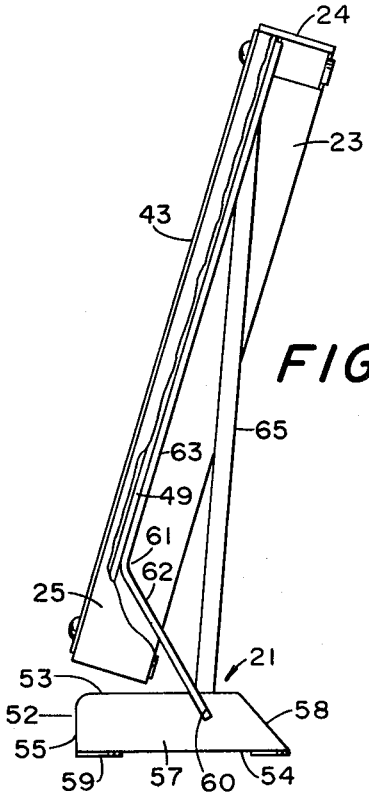
FIG. 9 is a slightly enlarged side elevational view, partly broken away and partly in section, of FIG. 8.
Figure 10:
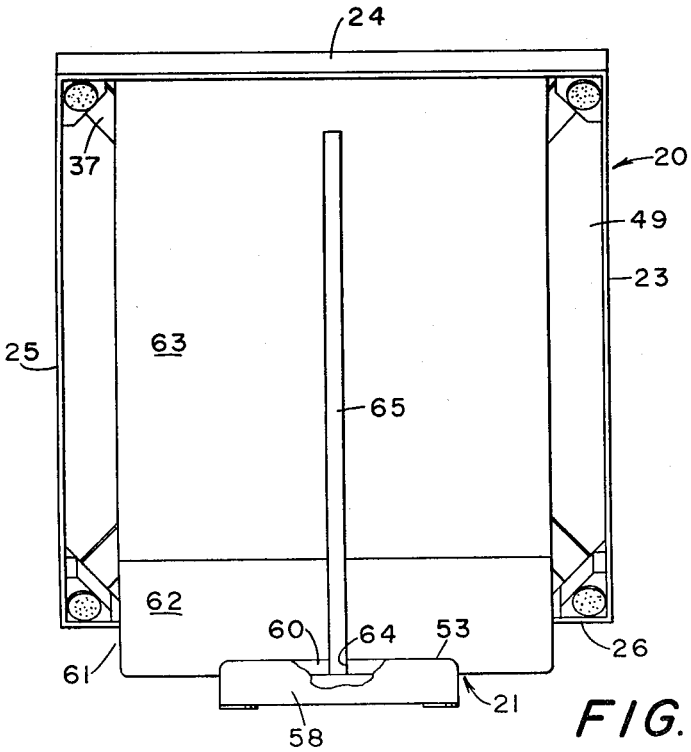
FIG. 10 is a rear elevational view, partly broken away and partly in section, of FIG. 8.
Figure 11:
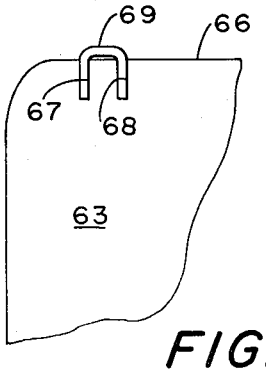
FIG. 11 is a fragmentary, greatly enlarged rear elevational view of an upper corner of the stand.

Referring now to the drawings, wherein like reference numerals designate like or corresponding parts throughout the several views, there is shown in FIG. 1 a preferred embodiment of photograph display and storage device 20 of the subject invention, adapted to lie flat upon any supporting surface or mounted upon stand 21 of FIGS. 8–10 of the drawings. More specifically, display and storage device 20 consists of an essentially square frame 22 comprising vertically extending sides 23–26, preferably of wood, mitered at each corner and conventionally secured together.

Figure 2:
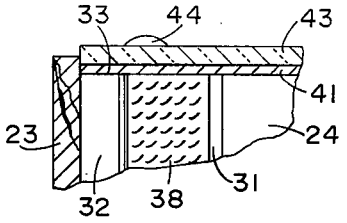
FIG. 2 is a fragmentary, greatly enlarged vertical sectional view taken through an upper corner of the preferred embodiment.
Figure 4:
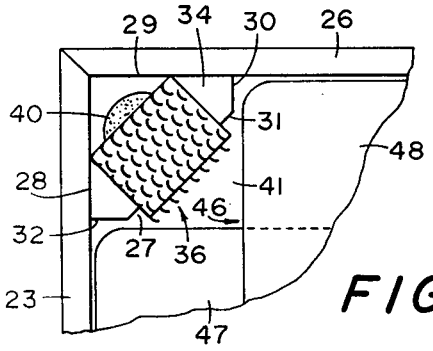
FIG. 4 is a fragmentary, greatly enlarged bottom plan view of a corner of the preferred embodiment, with the bottom plate removed.
Figure 5:
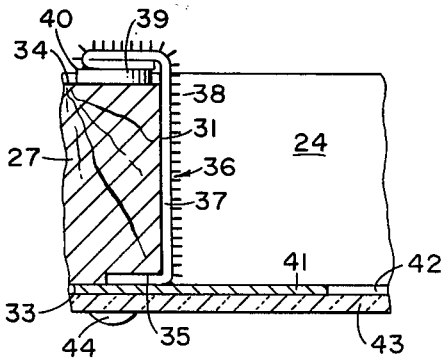
FIG. 5 is a fragmentary, greatly enlarged vertical sectional view of the invention in inverted condition, taken through a corner and strap, prior to placing mounting boards in the frame.
Figure 6:
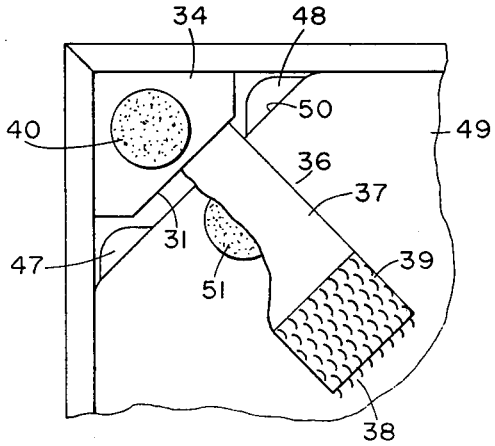
FIG. 6 is a fragmentary, greatly enlarged bottom plan view of a corner, partly broken away, showing mounting boards secured in position by the bottom plate.

As best seen in FIGS. 4 and 5, a polygonally-shaped and vertically elongate post 27 is provided in the interior corners of said frame, each such post includes perpendicularly disposed and vertically extending sides 28–29, a relatively short shoulder 30 normally perpendicular to the adjacent side of said frame, diagonally extending and vertically disposed flat 31, shoulder 32 corresponding in length to shoulder 30 and perpendicular to the adjacent side of said frame, flat top 33 lying slightly below the plane of the upper edge of said frame (see FIG. 2), and flat bottom 34 lying at least slightly above the plane of the lower edge of said frame. It is understood that each post 27 may be secured in the respective inner corners of said frame as by glueing or the like, or in an embodiment of the invention wherein said frame is molded of a suitable plastic, each such post is integrally formed therewith.

Figure 7:
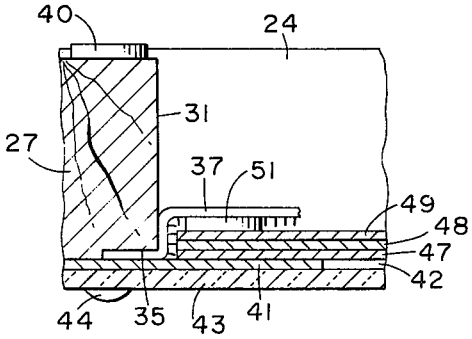
FIG. 7 is a fragmentary, greatly enlarged vertical sectional view taken through a corner of the invention, in inverted condition, with the strap secured to the bottom plate.

Referring now to FIGS. 5 and 7 of the drawings, a rectangularly-shaped and diagonally extending shallow recess 35 is provided in top 33 of post 27, said recess opens inwardly in flat 31. Flexible strap 36 of desired length and manufactured from a synthetic fibrous material under the tradename Velcro includes backing material 37 with a plurality of upstanding hooks 38 or other engaging means passing therethrough and terminating at least slightly beyond the face thereof. One end of strap 36, with backing material 37 extending downwardly, is conventionally secured in recess 35; the remote end of said strap includes section 39 wherein backing material 37 is turned back upon itself a short distance and conventionally secured. A circular pad 40 is secured to the approximate center of bottom 34 of each post and hooks 38 on section 39 are adapted to engage the same in one position of said strap. Desirably the surface of each such pad extends at least slightly beyond the plane of the corresponding edge of said frame (see FIG. 5).

Square overlay mat 41, including cut-out 42 of any desired shape and size, inserts in a relatively close fit inside frame 22 thus formed and is supported at each corner on top 33 of each post; transparent cover 43 is positioned over mat 41 and conventionally secured at each corner as by nails or screws 44 passing downwardly through said cover and mat into said post, or other conventional fastening means secured to the adjacent sides of said frame and adapted to bear against a selected portion of the upper surface of said cover. Preferably the upper surface of cover 43 extends at least slightly above the upper edge of said frame.

Figure 3:
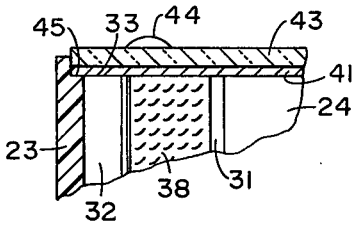
FIG. 3 is a fragmentary, greatly enlarged vertical sectional view taken through an upper corner of another embodiment of the invention.

In the modification of FIG. 3, recess 45 in the innermost, upper edge of said frame terminates downwardly in the plane of top 33 of said post whereby the most lateral sides of said overlay mat 41 are supported thereon as well as at each corner. Cover 43 inserts into said recess 45, overlies said mat, and is secured in the manner heretofore described.

In use, frame 22 is first inverted (see FIGS. 4–5) and placed upon any essentially horizontal supporting surface with the hooks on section 39 of strap 36 engaging pad 40. At such time any desired number of mounting boards 46 are placed within said frame. For example, a first mounting board 47 with a photograph or the like secured thereto is placed on overlay mat 41 intermediate shoulder 32 and the oppposing shoulder on the lower left-hand corner of said frame (not shown) with the photograph or picture extending downwardly and the longitudinal axis of said board 47 generally conforming to the major axis of cut-out 42. A second mounting board 48 is normally rotated ninety degrees relative to board 47 and placed intermediate shoulder 30 and the opposing shoulder in the upper right-hand corner of said frame (not shown); any desired number of mounting boards 46 may be stacked in such relationship within said frame.

Back plate 49, including angled corner 50 paralleling flat 31 and spaced slightly inwardly thereof, inserts into frame 22 in a relatively close fit. Circular pad 51 is secured to the lower surface of said plate 49 in the approximate center of corner 50 and spaced at least slightly inwardly thereof. Section 39 of strap 36 is disengaged from pad 40, a downward force applied to a selected corner of plate 49 thereby compressing the mounting boards 46 therebelow, and strap 36 turned downwardly and passed inwardly over pad 51 with hooks 38 engaging said pad. The remaining corners of plate 49 are secured in like manner. Mounting boards 46 are firmly held within said frame with the uppermost mounting board in proper position for displaying.

As heretofore mentioned, display and storage device 20 is also adapted to be mounted upon stand 21 of FIGS. 8–10. Base 52 of said stand, generally rectangular and preferably of wooden composition, includes top 53, bottom 54, front 55, opposing sides 56–57, and rearwardly inclined back 58; pads 59 or the like are secured in proximity to each corner of said bottom. Longitudinally extending and rearwardly inclined slot 60 in the rearmost position of said base extends approximately one-half therethrough and terminates laterally in sides 56, 57. Shaped support 61 of transparent plastic or the like and at least slightly lesser in width than the corresponding distance between shoulder 30 and the corresponding shoulder in the upper right-hand corner of said frame includes lower section 62 which inserts into slot 60, and extends angularly forwardly at an angle of approximately sixty degrees with respect to the horizontal for a relatively short distance. Upper section 63 of said support is turned rearwardly at an interior angle of approximately one hundred thirty degrees with respect to lower section 62.

Square recess 64 is provided in the approximate center of top 53 rearwardly of slot 60; standard 65 inserts downwardly into said recess in a relatively tight fit and is plastic welded or otherwise fixedly secured to the medial, lower portion of section 62. Standard 65 extends rearwardly with respect to the vertical and is fixedly secured to the medial, upper portion of section 63; the standard thus formed not only provides additional strength and rigidity for support 61 but also serves as a handle for carrying purposes. Desirably the most lateral corners of upper edge 66 of section 63 are provided with parallel, laterally-spaced bores 67–68; a flexible, inverted U-shaped member 69 of rubber or the like inserts into said bores.

In use, display and storage device 20, opening rearwardly, is elevated until top side 24 of said device clears upper edge 66 of section 63 of the stand. Upon lowering said device, members 69 frictionally engage the most lateral, inner surface of side 24 and back plate 49 uniformly bears against section 63 of said stand whereby the display and storage device 20 is slightly titled backwardly for an eye-pleasing effect.

It should be understood, of course, that the foregoing disclosure relates to only preferred embodiments of the invention and that numerous modifications or alterations may be made therein without departing from the spirit and scope of the invention as set forth in the appended claims.

What is claimed is:

1. A photograph display and storage device comprising an essentially square frame consisting of vertically extending top, bottom and opposing sides, a vertically extending post in each interior corner of said frame, each such post terminating upwardly at least slightly below the horizontal plane of the upper edge of said frame and terminating downwardly at least slightly above the horizontal plane of the lower edge of said frame, a plurality of first pads, one of which is secured to the bottom of each post, a strap consisting of a plurality of flexible, resilient hooks for detachable engagement with said first pads, each said strap secured at one end to the top of each post and in one position adapted to engage the corresponding pad on the bottom thereof, an overlay mat in said frame and bearing against the top of each said post, a cut-out in said mat, a transparent cover overlying said mat and secured to said frame, at least one mounting board adapted to receive a photograph mounted thereon, a back plate adapted to insert within said frame, a plurality of second pads, one of said second pads secured in each interior angle on the outer surface of said back plate, each said strap in a second position adapted to engage the corresponding second pad on said back plate and maintain said at least one mounting board in said frame.

2. The invention of claim 1 including an inwardly opening recess in the upper edge of said frame to receive said transparent cover.

3. In combination with the photograph display and storage device of claim 1, a stand comprising a base, a shaped support secured downwardly to said base, said support consisting of a forwardly directed lower section and a rearwardly directed upper section, friction means in a selected portion of said upper section, said back plate of said photograph display and storage device adapted to bear against said upper section of said stand, said friction means adapted to bear against the inner surface of said top of said frame.

* * * * *